United States Patent [19]

Sasai et al.

[11] 4,392,295

[45] Jul. 12, 1983

[54] METHOD AND APPARATUS FOR FORMING DRUM SEAM

[75] Inventors: Mitsuo Sasai; Kiyozi Tomikawa; Kazuo Kajiwara, all of Tokyo, Japan

[73] Assignee: Nittetsu Steel Drum Co., Ltd., Tokyo, Japan

[21] Appl. No.: 233,285

[22] Filed: Feb. 10, 1981

[30] Foreign Application Priority Data

| | | | |
|---|---|---|---|
| Oct. 27, 1980 | [JP] | Japan | 55/149281 |
| Dec. 4, 1980 | [JP] | Japan | 55/170203 |
| Jan. 9, 1981 | [JP] | Japan | 56/1053 |

[51] Int. Cl.[3] ..... B21D 39/00; B65D 6/34

[52] U.S. Cl. ..... 29/509; 413/41; 413/6; 220/67

[58] Field of Search ..... 413/41, 74, 75, 62, 413/36, 6; 29/446, 509, 511, 512; 220/79, 67

[56] References Cited

U.S. PATENT DOCUMENTS

| | | | |
|---|---|---|---|
| 247,816 | 10/1881 | Fancher | 413/36 |
| 475,656 | 5/1892 | Bertels | 220/79 |
| 1,496,246 | 6/1924 | Peyser | 413/41 |
| 1,731,136 | 10/1929 | Jackson | 413/41 |
| 2,197,439 | 4/1940 | Sebell | 220/67 |
| 2,312,102 | 2/1943 | Krueger | 413/41 |
| 2,327,731 | 8/1943 | McClary | 220/67 |
| 2,382,469 | 8/1945 | Diezel | 413/41 |
| 3,160,312 | 12/1964 | Johnston | 220/67 |
| 3,425,381 | 2/1969 | Wessely | 413/6 |
| 3,736,893 | 6/1973 | Coppens | 220/67 |
| 4,055,133 | 10/1977 | Wessely | 413/6 |
| 4,089,283 | 5/1978 | Mertens et al. | 413/6 |
| 4,263,860 | 4/1981 | Santoni | 220/67 |

*Primary Examiner*—Ervin M. Combs
*Assistant Examiner*—Steven E. Nichols
*Attorney, Agent, or Firm*—Wenderoth, Lind & Ponack

[57] ABSTRACT

A method and apparatus for forming a drum seam. A tray-like end plate having a cylindrical portion forming an indented shape and an outward extending end plate flange formed by the edge of the cylindrical portion is fitted into the end of a cylindrical drum body having a body flange extending outward from the edge thereof perpendicular to the cylindrical axis of the body with the end plate flange overlapping and extending along and beyond the body flange. A seaming chuck having a cylindrical forming face is fitted into the tray-like end plate for holding the body and end plate together with the forming face of the seaming chuck against the inner surface of said cylindrical portion and rotated for rotating the drum body and end plate. The seaming chuck has a fillet on the end adjacent the position where the end plate flange extends from the cylindrical portion and an inclined surface extending from the forming face outwardly thereof. A seaming roll having a circumferential forming groove therein opening toward the forming face of said seaming chuck is pressed radially inwardly toward the forming face of the seaming chuck for engaging the flanges and bending them over for interlocking them and forming them into a seam. The inclined surface of the fillet supports the corners of the flanges where they are bent out of the drum body and the end plate.

9 Claims, 21 Drawing Figures

METHOD AND APPARATUS FOR FORMING DRUM SEAM

BACKGROUND OF THE INVENTION

This invention relates to a method and apparatus for joining together a drum body and the top and bottom ends by seaming.

A steel drum is formed by fastening a round top and bottom plate to both ends of a cylindrical body. The fastening is generally accomplished by laying together the flanges at both ends of the body and around the circumference of the top and bottom plates and then bending them over in folds. During the forming process, sealing compound is filled into the space between the folds or in the seam to prevent the leakage of drum contents therethrough.

The drum seam has an important bearing on the quality of the drum, including its strength and leakage proofness. Formed at the edges of the drum, the seam is likely to strike against other objects during handling or transportation, thereby getting loosened, deformed or cracked. To avoid such problems, many proposals have been made, and put to practical use, as to the structure of the seam, the seaming method and the apparatus.

A drum maker produces each type of drum in large quantities (for example, on the order of several handred thousands per month), using an automatic continuous production line. The seaming process constitutes the most important part of the production line. Because of such mass production by the drum making line, even a slight time saving or equipment streamlining can result in a huge profit. The increasing need for commercial distribution rationalization calls for lighter containers. This trend necessitates the development of a seaming method and apparatus which can produce container seams with adequate strength and leakage-proofness.

Generally, the seam is formed as follows. A tray-like top and bottom plate is fitted to both ends of a cylindrical body, each end having a flange extending perpendicular to the longitudinal axis of the body. A seaming chuck having a cylindrical forming face is fitted on the top and bottom plates, which are then held, and turned, with the body. A seaming roll having a forming groove is pressed against the forming face of the seaming chuck, with the edges of the flanges on the body and top and bottom plates held in the forming groove. Consequently, the flange edges are guided along the side and bottom of the forming groove and thereby are folded and seamed together.

If the pressing in the foregoing conventional method is insufficient, the resulting seam has an internal wavy shape which leaves space between folds and leads to leakage. Excessive pressing, on the other hand, causes the circular internal top edge of the seam to become acute-angled. Under the influence of excess stress, the resulting corner becomes brittle and often develops a crack when subjected to impact during transportation. This tendency is particularly great with the triple and other multi-fold seams of light-gauge sheet metal.

SUMMARY OF THE INVENTION

This invention seeks to improve the conventional seaming method and apparatus and has been made in the light of the aforementioned background.

An object of this invention is to provide a method and apparatus for forming a seam which has high strength and leakage-proofness, using sheet metal of the same size as before and without increasing the amount of equipment or the operation time.

Another object of this invention is to provide a high-efficiency drum seaming method and apparatus for producing a good-shaped, tight, corner- and waviness-free seam, even in a triple or other multi-fold variation.

According to this invention, the flanges on the body and top and bottom plates (hereinafter called the end plates) are held and bent together by a seaming chuck having a cylindrical forming face and a seaming roll having a circumferential forming groove opening toward the forming face of the seaming chuck. Seaming is accomplished by pressing down the seaming roll toward the forming face of the seaming chuck being rotated.

In this method, the forming groove of the seaming roll bends the body and end plate flanges into a circular form first with a certain radius of curvature, then with a smaller radius of curvature. Such bending action is repeated until the body and end plate flanges form seven folds, whereupon the seam is pressed in the radial direction of the drum between the forming face of the seaming chuck and the bottom of the forming groove of the seaming roll.

To accomplish this fabrication effectively, the forming groove of the seaming roll according to this invention has a greater radius of curvature at a first (entry side) corner than at a second (exit side) corner.

Thus, the forming groove applies a two-stepped bending action to the flanges, with two different radii of curvature. Therefore, the bending progresses smoothly to produce a tight seam, without developing any excess deforming stress. Besides, since a single seaming roll performs both seaming and strengthening pressing, total working time is shortened and equipment simplified.

In bending together the body flange and the end plate flange, the seam is also pressed from the corner of the outer bottom edge thereof to the corner of the inner top edge thereof. For this purpose, the seaming chuck has a fillet, substantially triangular in section, extending circumferentially along the cylindrical forming face. One surface of this fillet extends along a datum plane perpendicular to the cylinder axis of the seaming chuck, and the other surface is an inclined plane facing the exit-side corner of the forming groove of the seaming roll.

Toward the end of the flange seaming process, the fillet moves in a direction such that the inclined surface thereof, which faces the exit-side corner of the forming groove of the seaming roll, presses the corner of the inner top edge of the seam. Therefore, said corner bends along the inclined fillet surface, facilitating smooth accomplishment of the seaming. At the same time, the inclined fillet surface flattens out any circumferential waviness. The flanges being pressed together not only between the forming face of the seaming chuck and the forming groove bottom of the seaming roll but also between the inclined fillet surface and the exit-side corner of the forming groove, a tightly interlocking seam results.

In some cases, a nip-bending roll and/or a finishing roll may be used in addition to the seaming roll.

The nip-bending roll is used for preliminarily bending the edge of the end plate flange prior to seaming. By this nip bending, the edge of the end plate flange is formed like a fishing hook, in section, and brought closer to the edge of the body flange. By so doing, the body and end plate flanges can be seamed together smoothly and tightly.

The finishing roll corrects the shape, and increases the tightness, of the seam as desired.

BRIEF DESCRIPTION OF THE DRAWINGS

FIG. 4(*b*) is a cross-sectional view on an enlarged scale of the fillet provided on the forming section.

FIG. 8(*b*) is a diagram for explaining the seaming process of this invention.

DETAILED DESCRIPTION OF THE PREFERRED EMBODIMENTS

Now preferred embodiments of this invention will be described at length.

Embodiment I

Figure 1:
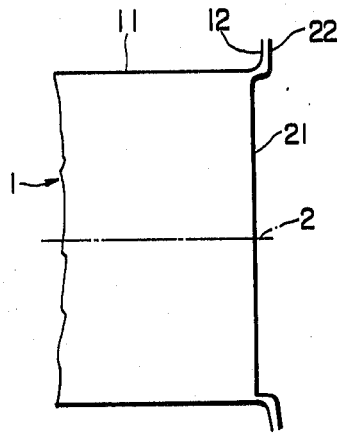
FIG. 1 is a partial cross-sectional view showing end plates provisionally fitted in a body.

FIG. 1 shows a preliminary stage to the seaming operation, in which a tray-like end plate 21 is provisionally fitted in a cylindrical body 11 of a drum 1. As shown, each end of the body 11 is bent outwardly, perpendicular to the axis 2 of the body, to form a flange 12. Likewise, the edge of the end plate 21 is bent so as to extend along the flange 12 of the body, forming a flange 22.

Figure 2:
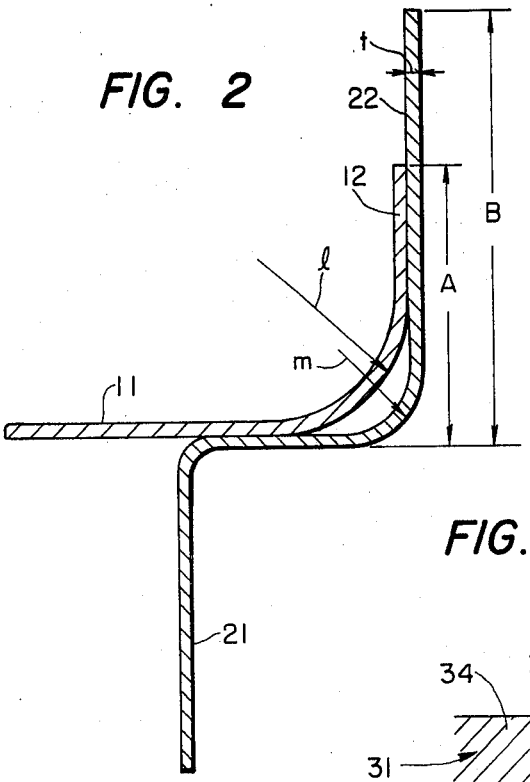
FIG. 2 is a cross-sectional view showing on an enlarged scale the flange portion of the body and end plate.

FIG. 2 is a detailed cross section of the flanges 12 and 22. As illustrated, the base portions of the flanges 12 and 22 are bent with radii of curvature l and m respectively, the flange 22 of the end plate 21 being longer than the flange 12 of the body 11. The flange lengths A and B must be long enough to form a seven-folded seam. The radii of curvature l and m at the flange base are such that the flanges 12 and 22 smoothly enter the forming groove in a seaming roll for bending. According to the experience of the inventors, the preferable radii of curvature are as follows:

$$l = 10 \sim 16 \times t$$

$$m = 5 \sim 10 \times t$$

wherein t=thickness of sheet metal.

To facilitate seaming, the edge of the flange 22 of the end plate 21 may be bent preliminarily in the direction of seaming, at an angle not larger than 90 degrees, using a press or other suitable device.

The pre-assembled body and end plate are held by a seaming chuck and seamed together by a seaming roll.

Figure 3:
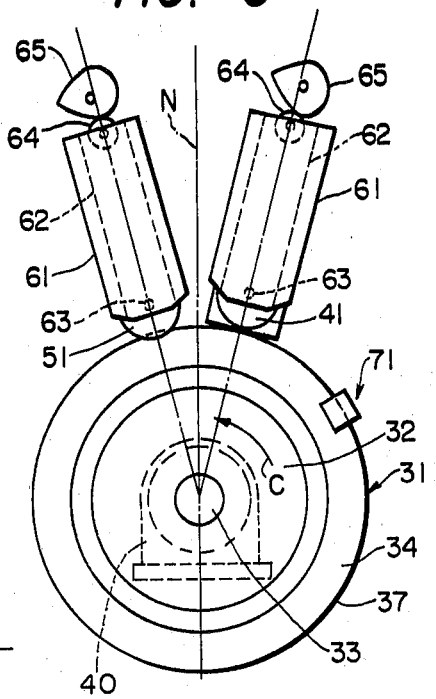
FIG. 3 is a front view of a seaming apparatus.

FIG. 3 is a schematic front view of a seaming apparatus. A seaming chuck 31 is attached to a base plate 32. A reducer-motor 40 rotates the seaming chuck 31 and base plate 32 together in the direction of arrow C through a drive shaft 33. The seaming chuck 31 is fitted in the indented part of the end plate 21, whereby the body 11 and end plate 21 are held by the seaming chuck 31.

A seaming roll 41 and a finishing roll 51 are provided near the seaming chuck 31. The two rolls 41 and 51 are circumferentially spaced at a suitable angle (for example, 15 degrees) on opposite sides of a vertical center line N through the axis of the shaft 33. The finishing roll 51 is positioned behind the seaming roll 41 when viewed in terms of the rotating direction of the seaming chuck 31. The rolls 41 and 42 are each rotatably supported, on a shaft 63, on the lower end of a press-down member 62 that moves up and down, guided by a casing 61. The rolls 41 and 51 rotate by following the rotation of the seaming chuck 31 through the seamed part of the body and end plate. A cam roller 64 is rotatably attached to the top of the press-down member 62, and a cam 65 is held in contact with the cam roller 64. As the cam 65 rotates, the press-down member 62 moves up and down to move the seaming roll 41 and finishing roll 51 in the direction of the radius of the seaming chuck 31.

A guide 71 is provided adjacent to and ahead of, relative to the direction of rotation of chuck 31, the seaming chuck 31. The guide 71 is spaced clockwise away from the seaming roll 41 at a suitable angle (for example, 45 degrees). As described later, the guide 71 correctly leads the flanges of the body and end plate into the forming groove of the seaming chuck 41.

Figure 4A:
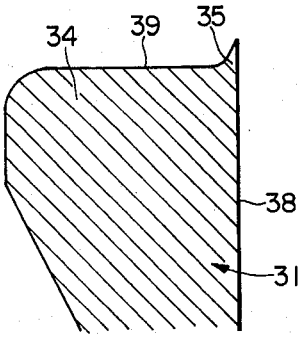
FIG. 4(*a*) is a cross-sectional view of a forming section of a seaming chuck according to this invention.
Figure 4B:
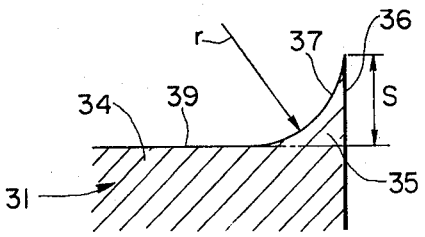

FIGS. 4*a* and 4*b* show details of the forming section of the seaming chuck. As shown, the seaming chuck 31 has a fillet 35, substantially triangular in crosssection, on the cylindrical section 34 thereof. One surface 36 of the fillet 35 extends along a datum surface 38 that contacts the entry-side guide face 48 of the seaming roller 41. The other surface of the fillet 35 forms an inclined surface (hereinafter called the inclined fillet surface 37). When the seaming roll 41 approaches the seaming chuck 31, the inclined fillet surface 37 faces the exit-side corner 46 of the forming groove 42 of the seaming roll shown in FIG. 5.

The inclined fillet surface 37 is a concave surface (generally having the shape of a quadrant) of a circle preferably having the following radius of curvature r and height S:

$$r \geqq 1.5t$$

$$S \geqq (1.0 \sim 3.5)t$$

If the radius of curvature r and height S are too small, the corner of the inner top edge of the finished seam becomes angular, impairing the tightness of the seam. It is most desirable that the height S be kept not greater than ½ of the thickness of the most heavily folded part of the seam to be formed. In this embodiment, the inclined fillet surface 37 is concave. But the inclined fillet surface 37 may be a flat plane defined by a straight line. When the inclined fillet surface 37 is a plane, it is preferable, though not always necessary, that the fillet 35 has a shape of an equilateral triangle in cross section.

Figure 5:
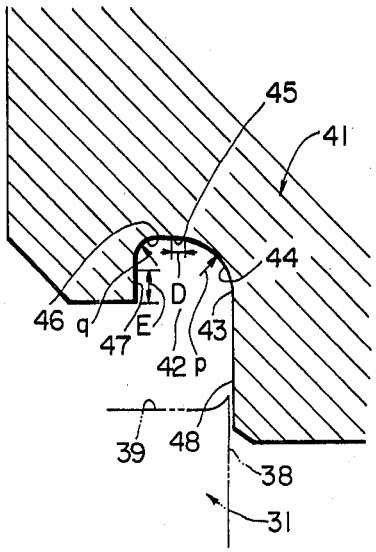
FIG. 5 is a detailed cross section of the forming groove of a seaming roll according to this invention.

The seaming roll 41 bends, rolls in, and seams the flanges 12 and 22 of the body 11 and end plate 21 respectively, the two being held together, finally pressing the seam thus formed. FIG. 5 is a cross-section of the seaming roll 41. The seaming roll 41 has a circumferential forming groove 42. The forming groove 42 is substantially D-shaped, opening toward the forming face 39 of the seaming chuck 31. In the forming groove 42, a portion between the entry-side surface (from which the flanges enter; on the right side in the figure) and a first corner 44 is substantially quadrantal in section. The groove bottom 45 following, in the direction of entry of the flanges, the first corner 44 is flat. A second corner 46 following the groove bottom 45 is defined by a quadrant whose radius of curvature is smaller than that of the first corner 44. The exit-side surface 47 following the second corner 46 extend straight toward the chuck 31. The guide face 48 extends downward below the entry-side surface 43. The guide face 48 guides the flanges 12 and 22 coming into the forming groove 42 and slides over the datum surface 38 on the seaming chuck 31.

To form a good-shaped, tight seam, the cross-sectional dimensions of the forming groove 42 should fall within the following ranges:

Radius of curvature of the first corner $$p = 3.0 \sim 6.0t$$

Radius of curvature of the second corner $$q = 1.5 \sim 3.0t$$

Length of the straight groove bottom $$D = 0 \sim 3.0t$$

Length of the exit-side surface $$E = 1.5 \sim 4.0t$$

Figure 6:
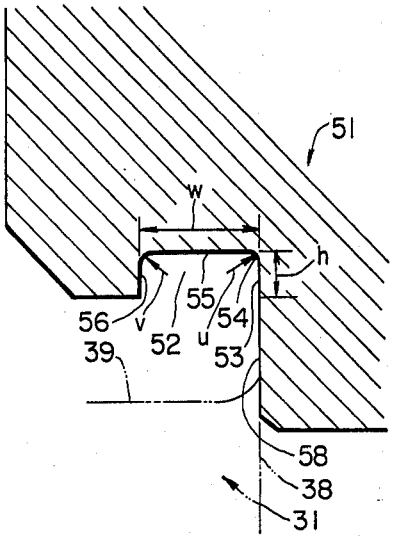
FIG. 6 is a detailed cross section of the forming groove of a finishing roll according to this invention.

The finishing roll 51 corrects the shape of the seamd formed by the seaming roll 41 and tightens the interlocking of the seam by pressing. FIG. 6 is a cross section of a finishing roll that sets the formed seam into a substantially rectangular shape in cross section. The finishing roll 51 has a circumferential forming groove 52. The forming groove 52 is substantially rectangular in cross section, opeing toward the forming face 39 of the seaming chuck 31. A first corner 54 and a second corner 56 of the forming groove 52 are substantially defined by quadrants whose radii of curvature u and v are equal to those of the corners at the outer top and bottom edges of the seam, respectively. The depth h and width w of the forming groove 52 are equal to ½ of the thickness and to the height of the seam. A guide surface 58 extends downward from the entry-side surface 53 of the forming groove 52. The guide surface 58 guides the seamed flanges coming into the forming groove 52, and slides over the datum surface 38 of the seaming chuck 31.

Figure 7:
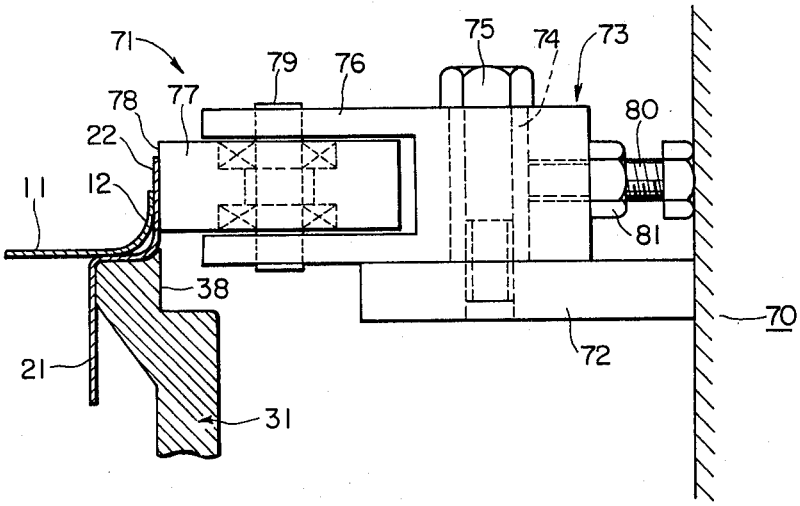
FIG. 7 is a side elevation of a guide device.

FIG. 7 shows details of a guide device. The body 70 of the seaming apparatus has a bracket 72, and a forked roll support 73 is attached thereto. The roll support 73 has a slot 74 in the base end thereof, and a fastening bolt 75 is screwed therethrough into the roll support 73. The forked part 76 carries a guide roll 77 that is rotatable on a pin 79, and an adjustment bolt 80 is screwed into the tail end of the support 73.

As mentioned previously, the guide device 71 is positioned ahead of the seaming roll 41 and adjacent to the seaming chuck 31. By turning the nut 81 on the adjustment bolt 80, the guide roll 77 is moved back and forth into position so that the external surface 78 of the guide roll 77 lies on the extension of the datum surface 38 of the seaming chuck 31.

The flange 22 of the end plate comes in contact with the guide roll 77 thus positioned, ahead of the seaming roll 41. Accordingly, the guide roll 77 leads the flange 22 so as to enter the forming groove 42 along the guide face 48 of the seaming roll 41. Usually projecting outward, the flange to be seamed is likely to become deformed as a result of a collision with another object during fabrication or transportation. The deformed flange 22 is likely to get bent, instead of entering the seaming roll 41. There is also a possibility that part of the deformed flange enters the exit end of the forming groove 42, thereby getting seamed in the reversed direction. Provision of the guide roll 77 prevents such bending and reversed seaming. If the edge of the flange 22 is inclined by the guide roll 77 relative to the guide plane 48, buckling of the flange 22, which is likely to occur during entering, too can be prevented.

The following describes the method of seaming the flanges of the body and end plate using the above-described apparatus.

Figure 8A:
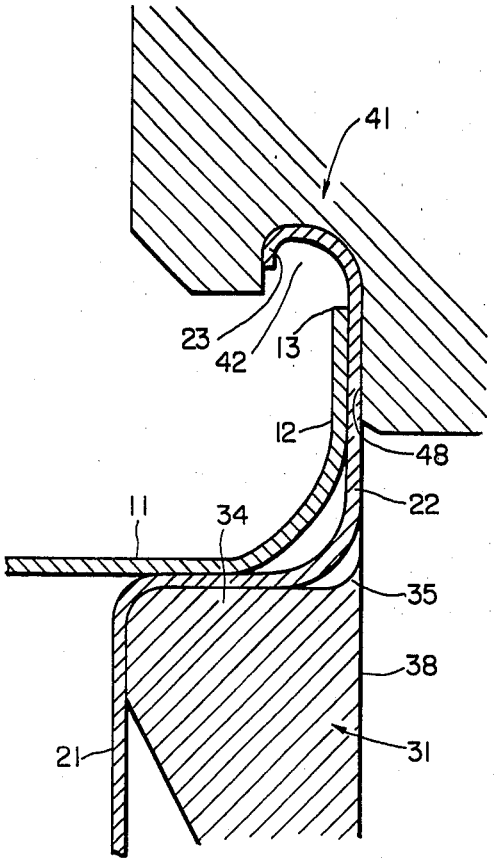
FIG. 8(*a*) is a diagram for explaining the nip-bending process of this invention.
Figure 8B:
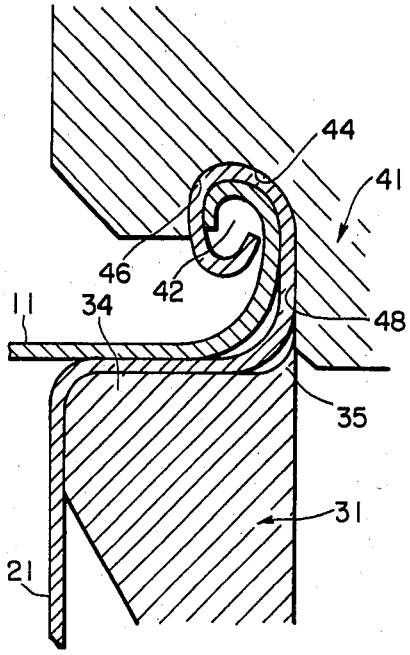

FIG. 8(*a*) shows the edge 23 of the flange of the end plate 21 nip-bent by the seaming chuck 31 and seaming roll 41. When the seaming roll 41 is pushed toward the seaming chuck 31, and rotating the chuck body 11 and end plate 21, the flange edge 23 of the end plate 21, supported by the cylindrical forming section 34 of the seaming chuck 31, passes along the guide face 48 into the forming groove 42. The flange edge 23 becomes bent while moving along the surface of the forming groove 42.

Before or after this nip-bending process, sealing compound is supplied to near the flange edge 13 of the body 11.

FIG. 8(*b*) shows a condition following the nip-bending, in which the flanges 12 and 22 are seamed together. When the seaming roll 41 is pressed further toward the seaming chuck 31, the flanges 12 and 22 pass along the guide face 38 into the forming groove 42. After being curved along the first corner 44, the flanges 12 and 22 pass through the flat groove bottom 45 into the second corner 46. The flanges 12 and 22, pre-curved at the first corner 44, are further curved at the second corner 46 to a greater curvature. Thus, the forming groove 42 curves the flanges 12 and 22 in two steps, with different radii of curvature. This enables smooth fabrication, applying great seaming action on the flanges 12 and 22 and without causing excess deforming stress.

Figure 9:
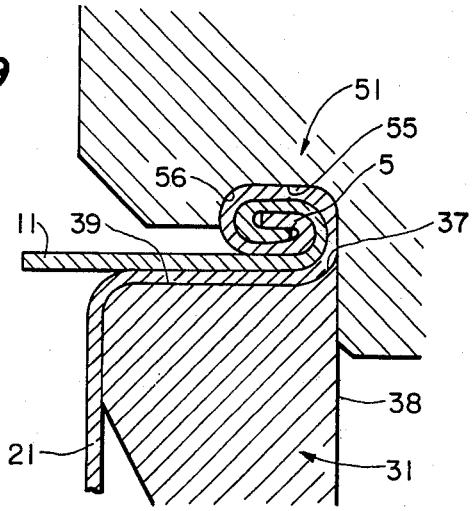
FIG. 9 explains the finishing process of this invention.

The seam thus formed is then corrected to a desired shape and further pressed for strengthening. FIG. 9 shows a finishing process in which such shape correcting and pressing are done. When the seam 5 has been formed, the seaming roll 41 withdraws (upward) and the finishing roll comes down. Then, the external half (or the upper half in FIG. 9) of the seam 5 enters the rectangular forming groove 52, where the forming plane 39 of the seaming chuck 31 and the bottom 55 of the forming groove 52 press the seam in the direction of the thickness thereof and the inclined fillet surface 37 and the exit-side corner 56 of the forming groove 52 in the diagonal direction. Consequently, the seam 5 is finished into the desired shape exactly and the seam is folded more tightly.

Figure 10:
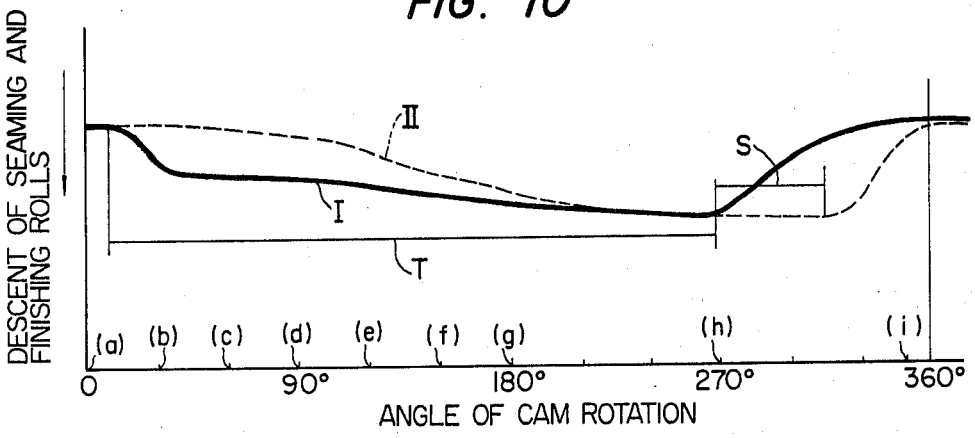
FIG. 10 is a graph which shows the relationship between the angle of rotation of a cam that raises and lowers the seaming and finishing rolls and the descent of the rolls.
Figure 11A:
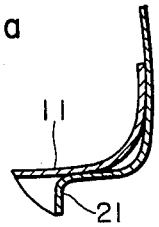
FIG. 11 is a series of cross-sectional sketches of a seam at different stages of the seaming process.
Figure 11B:
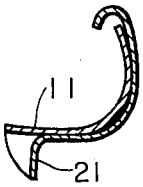
Figure 11C:
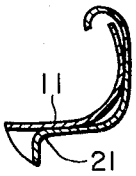
Figure 11D:
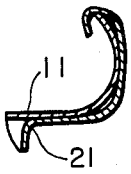
Figure 11E:
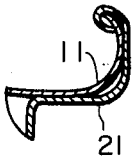
Figure 11F:
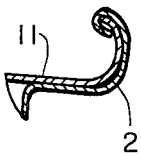
Figure 11G:
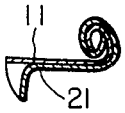
Figure 11H:
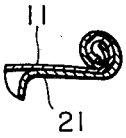
Figure 11I:
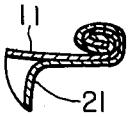

FIG.10 graphically shows the realtionship between the rotating angle of the cams that raise and lower the seaming and finishing rolls and the amount of descent of the rolls. FIG. 11 is a stepwise representation, in cross section, of the process in which the flanges are formed into a seam, related to the angles of cam rotation in FIG. 10.

In FIG. 10, curve I and interval T show the motion and the range of motion of the seaming roll, and curve II and interval S those of the finishing roll. The operation proceeds from (a) to (i) of FIG. 11. These sketches show a cycle in which the seaming chuck rotates 14 times while the cam rotates once. Nip-bending completed at (d). Seaming takes place between (d) and (h). Between (h) and (i), the cylindrical surface of the seaming chuck and the forming groove bottom of the finishing roll press the formed seam for further tightening and elimination of minor waviness resulting from the preceding seaming operation.

Figure 12:
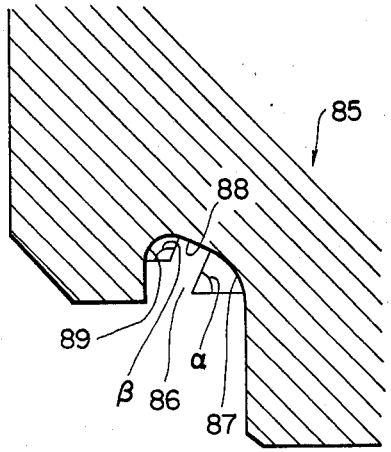
FIG. 12 is a detailed cross section of the forming groove of another seaming roll according to this invention.

The flat groove bottom 45 of the seaming roll 41 prevents irregular deformation of the flanges, absorbing the dimensional variations in the seam due to the variations in the supply of sealing compound and flange thickness. This is conductive to increasing the seaming speed. In this embodiment, as stated, the body and end-plate flanges are bent at each of the first and second corners in the forming groove substantially quadrantally or through an angle of substantially 90 degrees. However, the angle of bending according to this invention should not be limited to 90 degrees. FIG. 12 shows a seaming roll that provides differently angled bendings at the two corners. In the forming groove 86 of a seaming roll 85, a first (entry side) corner 87 is circularly shaped, the central angle $\alpha$ thereof being smaller than 90 degrees. A second (exit side) corner 89 has a smaller radius of curvature than the first corner 87, and the central angle $\beta$ thereof is greater than 90 degrees. The two corners 87 and 89 are connected smoothly by a straight line 88. The preferable radii of curvature of the corners and length of the straight section are the same as for the seaming roll 41. The two corners 87 and 89 may also be connected smoothly by a curve, instead of the straight line 88.

Although not essential for this invention, the finishing roll 51 is effective for tightening the seam since the compressive force thereof acts vertically, because the forming groove bottom 55 of the finishing roll 51 is parallel to the cylindrical surface 39 of the seaming chuck 31. With the seam having a hook- or egg-shaped cross section, however, the compressive force acts slantwise relative to the seaming direction and, therefore, has little tightening effect. It is a feature of this invention that seams having a variety of cross-sectional shapes (such as square, angled, elliptical and egg-like) can be formed by changing the shape of the forming groove 52.

Embodiment II

In this embodiment, nip-bending is carried out prior to seaming. The dimensions of the body and end plate flanges are the same as in Embodiment I (see FIG. 2). The elevating mechanism of the seaming chuck and roll is the same, too (see FIG. 3). Such identical parts are not explained here, and are designated by similar reference numerals.

Figure 13:
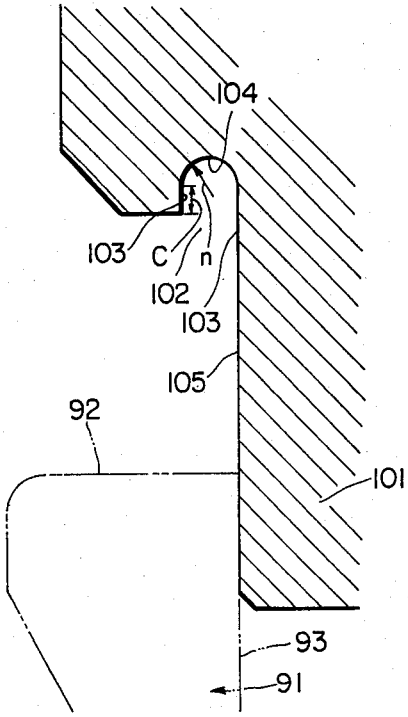

A nip-bending roll 101 pre-curves the edge of the flange 22 of the end plate 21. FIG. 13 is a cross-sectional view of the nip-bending roll 101, taken along the diameter thereof. As shown, the nip-bending roll 101 has a circumferential forming groove 102 that opens toward the cylindrical forming face 92 of a seaming chuck 91. A semicircular groove bottom 104 follows a flat guide face 103. A long face extending downward, following the flat side 103, acts as a guide face 105 that leads the end plate 21 coming into the forming groove 102. The guide face 105 slides over the rear surface of the seaming chuck 91.

According to the experience of the inventors, the preferable length C of the sides 103 of the forming groove 102 and the radius of curvature n of the groove bottom 104 are as follows:

$$C=1.5\sim2.5t$$

$$n=2.5\sim3.0t$$

The guide face 105 may be inclined relative to the side 103 at an angle of $\theta=0\sim10$ degrees. The side 103 and guide face 105 must be connected smoothly.

Figure 14:
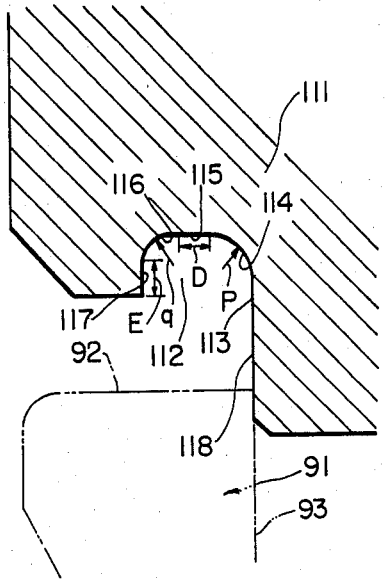
FIGS. 13 and 14 are cross-sectional views on an enlarged scale of the principal part of a nip-bending roll and still another seaming roll according to this invention.

A seaming roll 111 bends, rolls in, and seams the flanges 12 and 22 of the body 11 and end plate 21 respectively, the two being held together, finally pressing the seam thus formed. FIG. 14 is a cross section of the seaming roll 111. The seaming roll 111 has a circumferential forming groove 112 that is substantially D-shaped and opens toward the forming face 92 of the seaming chuck 91. In the forming groove 112, a portion between the entry-side surface 113 (from which the nip-bent flange enters; on the right side in the figure) and a first corner 114 is substantially quadrantal in section. The groove bottom 115 following the first corner 114 is flat. A second corner 116 following the groove bottom 115 is defined by a quadrant whose radius of curvature is smaller than that of the first corner 114. The exit-side surface 117 following the second corner 116 extends straight. A guide face 118 extends downward below the entry-side surface 113. The guide face 118 guides the flanges 12 and 22 coming into the forming groove 112 and slides over the rear surface 93 of the seaming chuck 91.

To form a good-shaped, tight seam, the cross-sectional dimensions of the forming groove 112 must be the same as those specified for Embodiment I. In addition, to effectively press the seam in the direction of the radius of the drum, the length D of the flat groove bottom should preferably be at least 0.2 t.

The nip-bending roll 101 is positioned slightly (for example, by 15 degrees) ahead of the seaming roll 111, relative to the rotating direction of the seaming chuck 91.

The following describes the method of seaming the flanges of the body and end plate using the above-described rolls.

Figure 15:
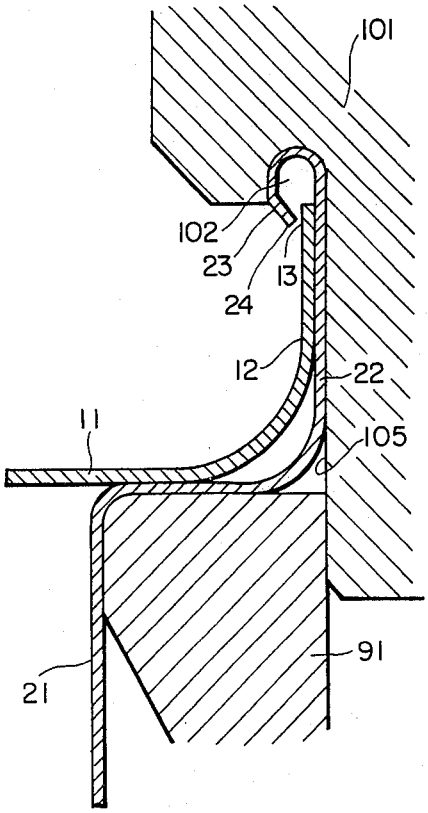
FIGS. 15 and 16 are cross sections showing the flange section being formed by the rolls of FIGS. 13 and 14, respectively.

FIG. 15 shows the edge of the end plate 21 nipbent by the seaming chuck 91 and nip-bending roll 101. On pushing down the nip-bending roll 101 toward the seaming chuck 91, the flange edge 23 of the end plate 21, held by the seaming chuck 91, passes along the guide face 105 into the forming groove 102. The flange edge 23 becomes bent while moving along the surface of the forming groove 102. The nip-bending roll 101 is pressed down until the flange edge 24 of the end plate 21 approaches the flange edge 13 of the body 11. At this point, the flange edge 23 has been bent through an angle of greater than 180 degrees, attaining a substantially hook-shaped cross section.

In the conventional seaming processes, the angle of nip-bending has not been as great as over 180 degrees. The flange edge 23 of the end plate forms the center of the seam, and is bent through an angle of over 500 degrees in the case of a seven-fold seam. So the object of such extensive nip-bending according to this invention is to facilitate the subsequent seaming.

Before or after this nip-bending, sealing compound is supplied to near the flange edge 13 of the body 11.

Figure 16:
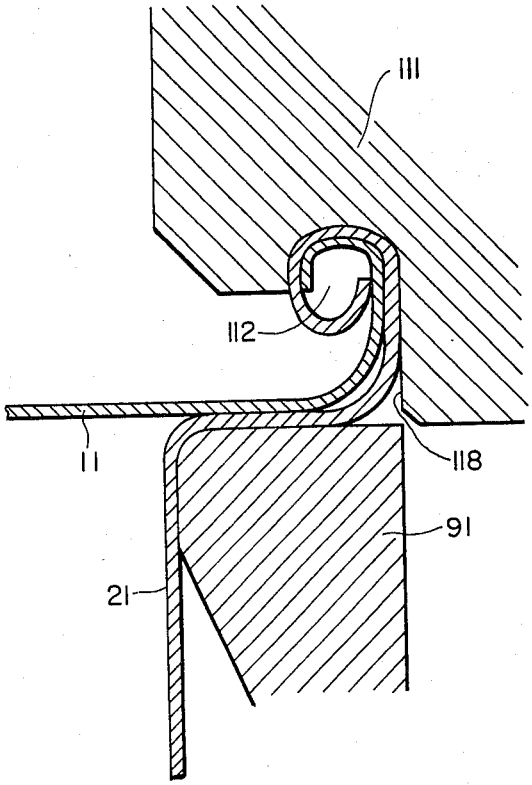

FIG. 16 shows the condition following the nip-bending, in which the flanges 12 and 22 are seamed together. On pressing down the seaming roll 111 toward the seaming chuck 91, the flanges 12 and 22 pass along the guide face 118 into the forming groove 112. After being curved along the first corner 114, the flanges 12 and 22 pass through the flat groove 115 into the second corner 116. The flanges 12 and 22, pre-curved at the first corner 114, are further curved at the second corner 116 to a greater curvature. Thus, the forming groove 112 curves the flanges 12 and 22 in two steps, with different radii of curvature. This permits smooth fabrication, applying great seaming action on the flanges 12 and 22 and without causing excess deforming stress. The flat groove bottom 115 prevents irregular deformation of the flanges, absorbing the dimensional variations in the seam due to the variations in the supply of sealing compound and flange thickness. This is conducive to increasing the seaming speed.

Figure 17:
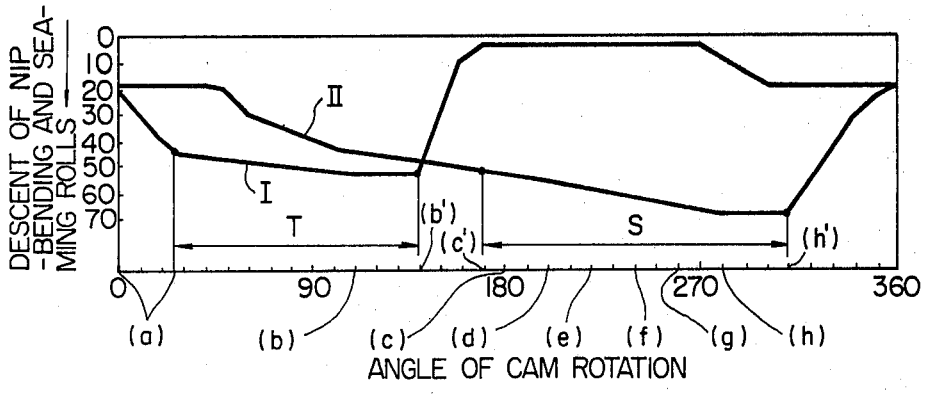
FIG. 17 is a graph showing the relationship between the angle of rotation of a cam that raises and lowers the nip-bending and seaming rolls of FIGS. 13 and 14 and the descent of the rolls.
Figure 18A:
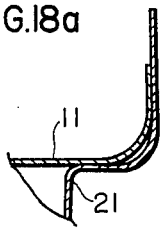
FIG. 18 is a series of cross-sectional sketches of a seam at different stages of the seaming process using the rolls of FIGS. 13 and 14.
Figure 18B:
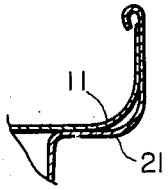
Figure 18C:
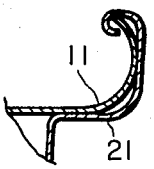
Figure 18D:
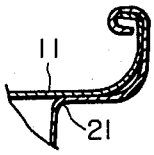
Figure 18E:
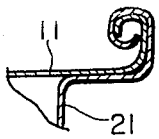
Figure 18F:
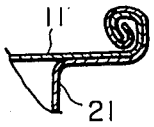
Figure 18G:
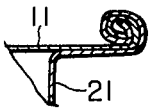
Figure 18H:
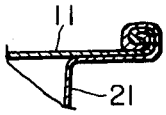

FIG. 17 graphically shows the relationship between the rotating angle of the cams that raise and lower the above forming rolls and the amount of descent of the same rolls. FIG. 18 is a stepwise representation, in cross section, of the process in which the flanges are formed into a seam, related to the angles of cam rotation in FIG. 18.

In FIG. 17, curve I and interval T show the motion and the range of motion of a first top cam, and curve II and interval S those of a second top cam. The seaming operation proceeds from (a) to (h) of FIG. 18. These sketches show a cycle in which the seaming chuck rotates 14 times while the cam rotates once. Nip-bending is completed at (b). Between (b) and (b'), waviness or creases in the curved surface are removed. Seaming starts at (c') and is substantially completed at (h). Between (h) and (h'), the cylindrical surface of the seaming chuck and the forming groove bottom of the seaming roll press the formed seam for further tightening (see FIG. 19) and elimination of minor waviness resulting from the preceding seaming operation. Since the cylindrical surface of the seaming chuck and the forming groove bottom of the seaming roll are parallel, the compressive force acts vertically on the seam to provide effective tightening. With the seam having a hook- or egg-shaped cross section, however, the compressive force acts slantwise relative to the seaming direction and, therefore, produces little tightening effect. Since a single seaming roll performs both seaming and tightening pressing, total working hours can be reduced.

Figure 19:
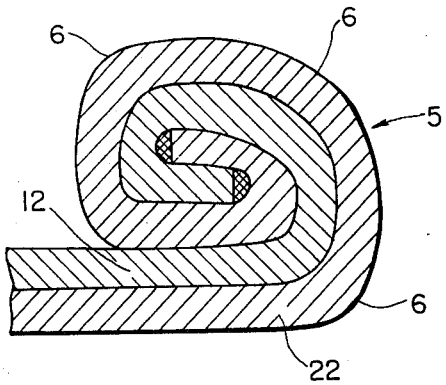
FIG. 19 is a cross section of a seam formed by the seaming method of this invention.

FIG. 19 is a cross-sectional view, on an enlarged scale, of a seam formed by this embodiment. As shown, the corner 6 of the seam 5 is bent at an angle of substantially 90 degrees, with a small radius of curvature. Therefore, the curved corner has no sharp-angled edges, which in turn prevents stress concentration and, thereby, increases the strength of the seam. The flanges 12 and 22 of the body and end plate thus tightly seamed together provided a good sealing.

This second embodiment employs a seaming chuck having no fillet. Of course, a filleted seaming chuck provides a tighter seam. Conversely, a seaming chuck having no fillet may be used in the first embodiment, as well.

What is claimed is:

1. A method of forming a drum seam which comprises the steps of:

fitting a tray-like end plate, having a cylindrical portion forming an indented shape and an end plate flange formed by the edge of the cylindrical portion extending outward from the edge of the cylindrical portion, into the end of a cylindrical drum body having a body flange extending outward from the edge of the cylindrical body perpendicular to the cylindrical axis of the body with said end plate flange overlapping and extending along and beyond the body flange;

fitting a seaming chuck having a cylindrical forming face into the tray-like end plate for holding the body and end plate together with the forming face of the seaming chuck against the inner surface of said cylindrical portion, and said seaming chuck having a fillet on the end adjacent the position where said end plate flange extends from said cylindrical portion, said fillet having an inclined surface extending from the forming face outwardly thereof;

rotating said seaming chuck for rotating the end plate and drum body around the cylindrical axis of the drum body; and pressing a seaming roll having a circumferential forming groove therein opening toward the forming face of said seaming chuck radially inwardly toward the forming face of the seaming chuck for engaging the flanges and bending them over for interlocking them and forming them into a seam, the bending comprising circularly curving the body and end plate flanges along a first circular cross-sectional portion of the forming groove, then further circularly curving the body and end plate flanges along a second circular cross-sectional portion of the forming groove having a smaller radius of curvature than that of the first circular cross-sectional portion, repeating the two step curving actions on successively more radially inward portions of the flanges until the body and end plate flanges form a seven-fold seam, the inclined surface of the fillet facing the second circular cross-sectional portion of the forming groove diagonally across the seam being formed and supporting the corners of the flanges where they bend from the drum body and the cylindrical portion, respectively, and finally pressing the formed seam between the forming face of the seaming chuck and the bottom of the forming groove in the direction of the radius of the drum.

2. The method as claimed in claim 1 in which said body flange is initially bent outwardly from the drum body with a radius of curvature of from 10 to 16 times the thickness of the flange, and the end plate flange is initially bent outwardly from the cylindrical portion with a radius of curvature of from 5 to 10 times the thickness of the flange.

3. The method as claimed in claim 1 further comprising, prior to seaming, the step of nip bending the edge of the end plate flange close to the edge of the body flange in a hook-like cross-sectional shape.

4. The method as claimed in claim 1 in which each circular curving curves said flanges through an angle of substantially 90°.

5. The method as claimed in claim 1 further comprising pressing a finishing roll radially inwardly against the formed seam for shaping the seam into a desired shape.

6. A drum seaming apparatus comprising:

a seaming chuck having a cylindrical forming face and being fittable into a cylindrical portion of a tray-like end plate fitted into the end of a cylindrical drum body for holding the body and end plate together with the forming face of the seaming chuck against the inner surface of the cylindrical portion;

driving means connected to said seaming chuck for rotating said seaming chuck around the cylindrical axis thereof for driving the drum body and end plate around the cylindrical axis of the drum body;

a seaming roll having a circumferential forming groove therein;

supporting means rotatably supporting said seaming roll with the opening of said forming groove facing the cylindrical surface of said seaming chuck;

reciprocating means operatively associated with said supporting means for reciprocally moving said supporting means radially of said seaming chuck for seaming together flanges extending radially from the cylindrical portion of the end plate and the end of the drum body, said forming groove having a cross-section with an entry side corner which is toward the outer end of the drum body having a circular shape and an exit side corner which is toward the middle of the drum body having a circular shape with a smaller radius of curvature than the entry side corner, the forming face of said seaming chuck having a circumferentially extending fillet thereon having a substantially triangular cross-section with one surface extending perpendicular to the cylindrical axis of the seaming chuck and constituting a datum surface and a second surface being inclined to the cylindrical forming face and facing the exit side corner of the forming groove in said seaming roll diagonally across the cross-section of the forming groove.

7. The apparatus as claimed in claim 6 in which the radius of curvature of said entry side corner is from 3 to 6 times the thickness of the sheet material of the flanges, the radius of the exit side corner is from 1.5 to 3 times the thickness of the sheet material of the flanges, and said cross-section of said forming groove has a flat portion connecting said corners which has a length up to 3 times the thickness of the sheet material of the flanges.

8. The apparatus as claimed in claim 6 further comprising a nip bending roll having a circumferential nip bending groove therein, nip bending roll mounting means for said nip bending roll and rotatably mounted said nip-bending roll with said nip bending groove opening toward the flanges and in a position ahead of, relative to the direction of rotation of the drum body and end plate, said seaming roll, and further reciprocating means operatively associated with said nip bending roll mounting means for reciprocally moving said nip bending roll mounting means radially of drum body.

9. The apparatus as claimed in claim 6 further comprising a finishing roll having a circumferential finishing groove therein, mounting means for said finishing roll and rotatably mounting said finishing roll with said finishing groove opening toward said seaming chuck and in a position behind, relative to the direction of rotation of the drum body and end plate, said seaming roll, and still further reciprocating means operatively associated with said finishing roll mounting means for reciprocally moving said finishing roll mounting means axially of said drum body.

* * * * *